US012656037B2

(12) United States Patent
Ootani

(10) Patent No.: US 12,656,037 B2
(45) Date of Patent: Jun. 16, 2026

(54) CRYOCOOLER AND METHOD FOR OPERATING CRYOCOOLER

(71) Applicant: SUMITOMO HEAVY INDUSTRIES, LTD., Tokyo (JP)

(72) Inventor: Yuuki Ootani, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 240 days.

(21) Appl. No.: 18/650,056

(22) Filed: Apr. 29, 2024

(65) Prior Publication Data

US 2024/0384906 A1 Nov. 21, 2024

(30) Foreign Application Priority Data

May 18, 2023 (JP) ..... 2023-082575

(51) Int. Cl.
*F25B 49/02* (2006.01)
*F25B 9/14* (2006.01)
*F25B 41/20* (2021.01)

(52) U.S. Cl.
CPC ..... *F25B 49/02* (2013.01); *F25B 9/14* (2013.01); *F25B 41/20* (2021.01); *F25B 2600/2501* (2013.01); *F25B 2700/19* (2013.01)

(58) Field of Classification Search
None
See application file for complete search history.

(56) References Cited

U.S. PATENT DOCUMENTS

| | | | | |
|---|---|---|---|---|
| 8,448,461 | B2 * | 5/2013 | Longsworth | F25B 9/14 62/401 |
| 9,480,934 | B2 * | 11/2016 | Matsui | F25B 45/00 |
| 11,156,387 | B2 | 10/2021 | Hirayama | |
| 12,516,852 | B2 * | 1/2026 | Yokodo | F25B 9/14 |
| 2012/0240537 | A1 * | 9/2012 | Maruyama | F25B 43/02 55/476 |
| 2015/0027155 | A1 * | 1/2015 | Maruyama | F25B 31/006 62/228.1 |
| 2020/0284486 | A1 * | 9/2020 | Semura | F25B 43/02 |
| 2021/0270500 | A1 * | 9/2021 | Semura | F25B 25/005 |
| 2022/0107119 | A1 * | 4/2022 | Liu | F25B 9/06 |
| 2022/0146166 | A1 * | 5/2022 | Yokodo | F25B 49/02 |
| 2023/0033344 | A1 * | 2/2023 | Dunn | F25B 41/45 |
| 2024/0125548 | A1 * | 4/2024 | Suzuki | F25B 9/14 |
| 2025/0244065 | A1 * | 7/2025 | Yokodo | F04B 37/00 |

FOREIGN PATENT DOCUMENTS

| | | | | |
|---|---|---|---|---|
| JP | S62-171762 | U | 10/1987 | |
| JP | 2725631 | B2 | 3/1998 | |
| JP | 2001-074326 | A | 3/2001 | |
| WO | WO-2019181596 | A1 * | 9/2019 | A61B 5/055 |
| WO | WO-2022176652 | A1 * | 8/2022 | F25B 9/00 |

* cited by examiner

*Primary Examiner* — Jenna M Maroney
(74) *Attorney, Agent, or Firm* — HEA Law PLLC

(57) ABSTRACT

A cryocooler includes: a compressor; a cold head; a bypass valve that is connected to the compressor to bypass the cold head; and a controller that is configured to stop the compressor, open the bypass valve with a delay from the stopping of the compressor, and operate the cold head during at least a portion of a period from the stopping of the compressor to the opening of the bypass valve.

7 Claims, 5 Drawing Sheets

CRYOCOOLER AND METHOD FOR OPERATING CRYOCOOLER

CROSS-REFERENCE TO RELATED APPLICATIONS

This application claims priority to Japanese Patent Application No. 2023-082575, filed on May 18, 2023, which is incorporated by reference herein in its entirety.

BACKGROUND

Technical Field

A certain embodiment of the present invention relates to a cryocooler and a method for operating a cryocooler.

Description of Related Art

In general, an oil-lubricated compressor is often used in a cryocooler such as a Gifford-McMahon (GM) cryocooler. Since a high-pressure refrigerant gas compressed by the compressor can include lubricating oil, an oil separator and an adsorber are provided. The oil separator separates oil from the high-pressure refrigerant gas and collects the oil. The adsorber removes a residual oil component from the high-pressure refrigerant gas that has passed through the oil separator using adsorption. Therefore, the high-pressure refrigerant gas is purified by the oil separator and the adsorber and is supplied to a cold head that acts as an expander. The refrigerant gas whose pressure has been reduced by expansion in the cold head is collected to the compressor. The compressor is provided with a bypass flow path that connects a high-pressure-side refrigerant gas flow path to a low-pressure-side refrigerant gas flow path.

SUMMARY

According to an embodiment of the present invention, there is provided a cryocooler including: a compressor; a cold head; a bypass valve that is connected to the compressor to bypass the cold head; and a controller that is configured to stop the compressor, open the bypass valve with a delay from the stopping of the compressor, and operate the cold head during at least a portion of a period from the stopping of the compressor to the opening of the bypass valve.

According to another embodiment of the present invention, there is provided a method for operating a cryocooler. The cryocooler includes a compressor, a cold head, and a bypass valve connected to the compressor to bypass the cold head. The method includes: stopping the compressor; opening the bypass valve with a delay from the stopping of the compressor; and operating the cold head during at least a portion of a period from the stopping of the compressor to the opening of the bypass valve.

DETAILED DESCRIPTION

Figure 1:
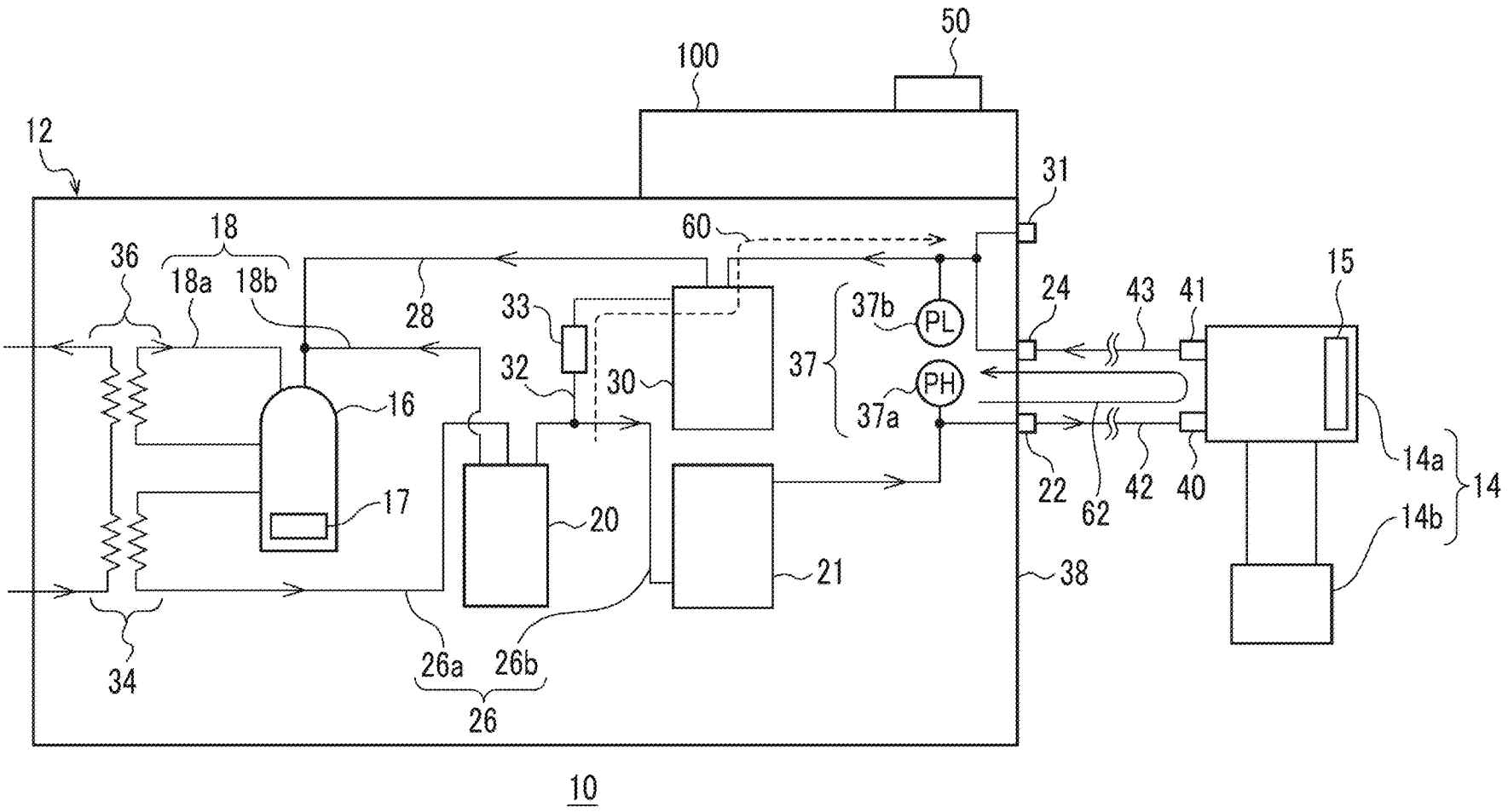
FIG. 1 is a diagram schematically illustrating a cryocooler according to an embodiment.

The present inventors found that, in the above-described cryocooler, even though the refrigerant gas from which oil had been removed was supplied to the cold head, the low-pressure-side refrigerant gas flow path, through which a low-pressure refrigerant gas collected from the cold head to the compressor flowed, was sometimes contaminated with oil.

It is desirable to respond to oil contamination that may occur in a low-pressure-side refrigerant gas flow path of a cryocooler.

Hereinafter, an embodiment for carrying out the present invention will be described in detail with reference to the drawings. In the description and the drawings, the same or equivalent components, members, and processes are denoted by the same reference numerals, and a redundant description thereof will be omitted as appropriate. The scale or shape of each portion illustrated in the drawings is conveniently set for ease of description and is not to be construed as limiting unless stated otherwise. The embodiment is only an example and does not limit the scope of the present invention. All features described in the embodiment or combinations thereof are not necessarily essential to the present invention.

FIG. 1 is a diagram schematically illustrating a cryocooler according to the embodiment.

A cryocooler 10 includes a compressor 12 and a cold head 14. The compressor 12 is configured to collect a refrigerant gas of the cryocooler 10 from the cold head 14, to pressurize the collected refrigerant gas, and to supply the refrigerant gas to the cold head 14 again. The compressor 12 is also referred to as a compressor unit. The cold head 14 is also referred to as an expander and includes a room-temperature section 14*a* and a low-temperature section 14*b* which is also referred to as a cooling stage. The compressor 12 and the cold head 14 constitute a refrigeration cycle of the cryocooler 10. Therefore, the low-temperature section 14*b* is cooled to a desired cryogenic temperature. The refrigerant gas is also referred to as a working gas and is generally a helium gas. However, other suitable gases may be used.

For example, the cryocooler 10 is a single-stage or two-stage Gifford-McMahon (GM) cryocooler. However, the cryocooler 10 may be a pulse tube cryocooler, a Stirling cryocooler, or other types of cryocoolers. The cold head 14 has a different configuration depending on the type of the cryocooler 10, and the compressor 12 can use the configuration described below regardless of the type of the cryocooler 10.

In addition, in general, both the pressure of the refrigerant gas supplied from the compressor 12 to the cold head 14 and the pressure of the refrigerant gas collected from the cold head 14 to the compressor 12 are considerably higher than the atmospheric pressure and can be called a first high pressure and a second high pressure, respectively. For convenience of description, the first high pressure and the second high pressure are also simply called a high pressure and a low pressure, respectively. Typically, the high pressure is, for example, 2 to 3 MPa. The low pressure is, for example, 0.5 to 1.5 MPa and is, for example, approximately 0.8 MPa.

The compressor 12 includes a compressor main body 16, an oil line 18, an oil separator 20, and an adsorber 21. In addition, the compressor 12 includes a discharge port 22, a suction port 24, a discharge flow path 26, a suction flow path 28, a storage tank 30, a refrigerant gas charge port 31, a bypass flow path 32 having a bypass valve 33, and a refrigerant gas cooling unit 34, and an oil cooling unit 36.

The compressor main body 16 is configured to internally compress the refrigerant gas sucked from a suction port thereof and to discharge the refrigerant gas from a discharge port. The compressor main body 16 may be, for example, a scroll pump, a rotary pump, or other pumps that pressurize the refrigerant gas. The compressor main body 16 is called a compression capsule in some cases.

The compressor main body 16 includes a compressor motor 17 as a drive source thereof. For example, the compressor motor 17 is an electric motor that is supplied with power from an external power source (for example, a commercial three-phase alternating current power source) to operate. For example, the compressor motor 17 may operate at a predetermined operating frequency, that is, a rotating speed corresponding to a power supply frequency. Therefore, the compressor main body 16 may discharge a fixed and predetermined amount of refrigerant gas. Alternatively, the compressor motor 17 may be configured to have a variable operating frequency, that is, a variable rotating speed. Therefore, the compressor main body 16 may be configured to discharge a variable amount of refrigerant gas. In this case, a compressor inverter that controls the operating frequency of the compressor motor 17 under the control of a controller 100, which will be described below, may be connected between the compressor motor 17 and the controller 100. The operating frequency of the compressor motor 17 may be controlled in a range of 30 Hz to 100 Hz or a range of 40 Hz to 70 Hz.

The compressor main body 16 is an oil-lubricated type in which oil is used for lubrication and cooling, and the sucked refrigerant gas is directly exposed to the oil inside the compressor main body 16. Therefore, the refrigerant gas is delivered from the discharge port in a state of being slightly mixed with the oil.

The oil line 18 includes an oil circulation line 18*a* and an oil return line 18*b*. The oil circulation line 18*a* includes the oil cooling unit 36 and is configured such that the oil flowing out from the compressor main body 16 is cooled by the oil cooling unit 36 and flows into the compressor main body 16 again. An orifice that controls the flow rate of the oil flowing through the oil circulation line 18*a* may be provided in the oil circulation line 18*a*. In addition, a filter that removes dust included in the oil may be provided in the oil circulation line 18*a*. The oil return line 18*b* connects the oil separator 20 to a suction flow path 28 in order to return the oil collected by the oil separator 20 to the compressor main body 16. The refrigerant gas including the oil collected by the oil separator 20 flows through the oil return line 18*b*. A filter that removes dust included in the oil separated out by the oil separator 20 and an orifice that controls the amount of oil returning to the compressor main body 16 may be provided in the middle of the oil return line 18*b*.

The oil separator 20 is provided to separate, from the refrigerant gas, the oil mixed with the refrigerant gas when passing through the compressor main body 16. The oil separator 20 is connected to the discharge port of the compressor main body 16 through an upstream portion 26*a* of the discharge flow path 26. In addition, the oil separator 20 is connected to the discharge port 22 through a downstream portion 26*b* of the discharge flow path 26.

The adsorber 21 is provided in the discharge flow path 26 and adsorbs a gaseous oil component (for example, vaporized oil or mist-like oil) or moisture in the refrigerant gas to purify the refrigerant gas. The adsorber 21 is disposed in the middle of the downstream portion 26*b* of the discharge flow path 26, that is, on the discharge flow path 26 between the oil separator 20 and the discharge port 22.

The discharge port 22 is a refrigerant gas outlet that is provided in a compressor casing 38 in order to deliver the refrigerant gas, which has been pressurized to a high pressure by the compressor main body 16, from the compressor 12. The suction port 24 is a refrigerant gas inlet that is provided in the compressor casing 38 in order for the compressor 12 to receive a low-pressure refrigerant gas. The discharge flow path 26 connects the discharge port 22 to the discharge port of the compressor main body 16. The refrigerant gas discharged from the compressor main body 16 to the discharge port 22 flows through the discharge flow path 26. The suction flow path 28 connects the suction port 24 to the suction port of the compressor main body 16. The refrigerant gas sucked from the suction port 24 to the compressor main body 16 flows through the suction flow path 28. Each of the discharge flow path 26 and the suction flow path 28 is an internal pipe of the compressor 12 provided in the compressor casing 38 and may be a flexible pipe or a rigid pipe.

The storage tank 30 is provided as a volume for removing pulsation included in the low-pressure refrigerant gas returning from the cold head 14 to the compressor 12. The storage tank 30 is disposed in the suction flow path 28.

The refrigerant gas charge port 31 is provided in the compressor casing 38 as a filling port for filling the cryocooler 10 with the refrigerant gas. In this embodiment, the refrigerant gas charge port 31 is connected to the suction flow path 28 between the storage tank 30 and the suction port 24. Alternatively, the refrigerant gas charge port 31 may be connected to the storage tank 30. The refrigerant gas charge port 31 may be normally closed by a lid. When the cryocooler 10 is filled with the refrigerant gas, a refrigerant gas tank is connected to the refrigerant gas charge port 31, and the refrigerant gas is supplied from the refrigerant gas tank into the compressor 12 through the refrigerant gas charge port 31.

The bypass valve 33 is connected to the compressor 12 to bypass the cold head 14. The bypass valve 33 is provided on the bypass flow path 32. The bypass flow path 32 connects the discharge flow path 26 to the suction flow path 28 such that the flow path bypasses the cold head 14 and the refrigerant gas is recirculated from the discharge flow path 26 to the suction flow path 28. For example, as illustrated in FIG. 1, the bypass flow path 32 may branch from the discharge flow path 26 between the oil separator 20 and the adsorber 21 and may be connected to the storage tank 30.

The bypass valve 33 is closed during the operation of the cryocooler 10 to separate the discharge flow path 26 from the suction flow path 28 such that a pressure difference between a high-pressure side and a low-pressure side of the cryocooler 10 is maintained. The bypass valve 33 is opened when the operation of the cryocooler 10 is stopped, which will be described in detail below. The bypass valve 33 is opened to allow the inflow of the refrigerant gas from the discharge flow path 26 to the suction flow path 28 through the bypass flow path 32, and the pressures of the refrigerant gas in the discharge flow path 26 and the suction flow path 28 are equalized. Therefore, the bypass valve 33 may also be referred to as a pressure equalizing valve. For example, the bypass valve 33 may be a normally open on-off valve or may be opened naturally when the supply of power to the cryocooler 10 is stopped.

In addition, a flow rate control valve may be provided in the bypass flow path 32 in parallel with the bypass valve 33. The flow rate control valve may be used to adjust the differential pressure between the discharge flow path 26 and the suction flow path 28. Alternatively, the opening degree of the bypass valve 33 may be adjustable, and the bypass valve 33 may be used to adjust the differential pressure between the discharge flow path 26 and the suction flow path 28 during the operation of the cryocooler 10.

The refrigerant gas cooling unit 34 and the oil cooling unit 36 constitute, for example, a cooling system that cools the compressor 12 using a cooling medium such as cooling water. The refrigerant gas cooling unit 34 is disposed in the upstream portion 26*a* of the discharge flow path 26 and is provided to cool the high-pressure refrigerant gas heated by compression heat generated in association with the compression of the refrigerant gas in the compressor main body 16. The refrigerant gas cooling unit 34 cools the refrigerant gas using heat exchange between the refrigerant gas and the cooling medium. Further, the oil cooling unit 36 cools the oil using heat exchange between the oil flowing out from the compressor main body 16 and the cooling medium. The cooling medium is supplied to the compressor 12 from the outside and is discharged to the outside of the compressor 12 through the refrigerant gas cooling unit 34 and the oil cooling unit 36. In this way, the compression heat generated by the compressor main body 16 is removed to the outside of the compressor 12 together with the cooling medium. Further, the cooling medium may be cooled by, for example, a chiller (not illustrated) and supplied again.

In addition, the cryocooler 10 is provided with a pressure sensor 37 (for example, a first pressure sensor 37*a* and/or a second pressure sensor 37*b*). The pressure sensor 37 measures the differential pressure between the inlet and outlet of the bypass valve 33, the inlet-side pressure of the bypass valve 33, or the outlet-side pressure of the bypass valve 33. For example, the first pressure sensor 37*a* is disposed in the discharge flow path 26 to measure the pressure of the refrigerant gas flowing through the discharge flow path 26. The first pressure sensor 37*a* is configured to output a first measured pressure signal PH indicating the measured pressure to the controller 100. In this way, the first pressure sensor 37*a* can measure the inlet-side pressure of the bypass valve 33. The second pressure sensor 37*b* is disposed in the suction flow path 28 to measure the pressure of the refrigerant gas flowing through the suction flow path 28. The second pressure sensor 37*b* is configured to output a second measured pressure signal PL indicating the measured pressure to the controller 100. In this way, the second pressure sensor 37*b* can measure the outlet-side pressure of the bypass valve 33. In addition, the differential pressure between the inlet and outlet of the bypass valve 33 can be acquired from the pressures measured by the first pressure sensor 37*a* and the second pressure sensor 37*b*.

The compressor casing 38 accommodates components of the compressor 12, such as the compressor main body 16, the oil separator 20 and the adsorber 21 on the discharge flow path 26, and the storage tank 30 on the suction flow path 28. The refrigerant gas cooling unit 34, the oil cooling unit 36, and the pressure sensor 37 are also accommodated in the compressor casing 38.

The cold head 14 includes a high pressure port 40 and a low pressure port 41 in the room-temperature section 14*a* as refrigerant gas inlet and outlet of the cold head 14, respectively. The high pressure port 40 is connected to the discharge port 22 of the compressor 12 by a high-pressure pipe 42, and the low pressure port 41 is connected to the suction port 24 of the compressor 12 by a low-pressure pipe 43. The high-pressure pipe 42 and the low-pressure pipe 43 are disposed outside the compressor 12. The high-pressure pipe 42 and the low-pressure pipe 43 are generally flexible pipes, but may be rigid pipes.

The cold head 14 includes a cold head motor 15 that drives the cold head 14. As is known, the cold head motor 15 drives a pressure switching valve that alternately connects a refrigerant gas expansion space in the cold head 14 to the high pressure port 40 and the low pressure port 41. Further, in the case of the GM cryocooler, the cold head motor 15 drives a displacer that determines the volume of the expansion space in the cold head 14. When the cold head motor 15 is driven, a periodic volume fluctuation and a fluctuation in the pressure of the refrigerant gas synchronized with the periodic volume fluctuation occur in the expansion space. Therefore, a refrigeration cycle (for example, a GM cycle) of the cryocooler 10 is configured.

The cold head motor 15 is, for example, an electric motor that is supplied with power from the external power source (for example, the commercial three-phase alternating current power source) to operate. The cold head motor 15 may be connected to the external power source through the compressor 12. In other words, the compressor 12 may be provided as a power source for the cold head motor 15. For example, the cold head motor 15 may operate at a predetermined operating frequency, that is, a rotating speed corresponding to a power supply frequency. In this case, the cold head motor 15 may generate the refrigeration cycle of the cold head 14 at a predetermined frequency. Alternatively, the cold head motor 15 may have a variable operating frequency, that is, a variable rotating speed, and thereby the frequency of the refrigeration cycle generated in the cold head 14 may be variable. In this case, a cold head inverter that controls the operating frequency of the cold head motor 15 under the control of the controller 100 may be connected between the cold head motor 15 and the controller 100. The operating frequency of the cold head motor 15 may be controlled in a range of 30 Hz to 100 Hz or a range of 40 Hz to 70 Hz.

The cryocooler 10 may include a main switch 50 for switching on and off the cryocooler 10. For example, the main switch 50 may be installed in the compressor 12. When the main switch 50 is turned on, the compressor 12 and the cold head 14 are operated. When the main switch 50 is turned off, the operation of the compressor 12 and the cold head 14 is stopped. The main switch 50 may be manually operable. Together with or instead of this operation, the main switch 50 may be automatically switched according to a predetermined condition. For example, the main switch 50 may switch on or off the cryocooler 10 according to a predetermined schedule.

In addition, the cryocooler 10 is provided with the controller 100 that controls the cryocooler 10. The controller 100 is configured to control the turn-on and turn-off of the cryocooler 10. For example, the controller 100 is connected to the compressor motor 17 to control the turn-on and turn-off of the compressor motor 17. The controller 100 turns on (or off) the compressor motor 17 to operate (stop) the compressor 12. Similarly, the controller 100 is connected to the compressor motor 17 to control the turn-on and turn-off of the cold head motor 15. The controller 100 turns on (or off) the cold head motor 15 to operate (stop) the cold head 14. Further, the controller 100 is connected to the bypass valve 33 to control the turn-on and turn-off (that is, opening and closing) of the bypass valve 33.

The controller 100 may be configured to stop (that is, turn off) the operation of the cryocooler 10 in response to an operation stop command during the operation of the cryocooler 10. The operation stop command may be generated by an operation of turning off the main switch 50 and may be input to the controller 100 from the main switch 50. Alternatively, the operation stop command may be generated by internal processing in the controller 100. Alternatively, the operation stop command may be generated by another controller (for example, a host controller that controls a host device into which the cryocooler 10 has been incorporated) that is connected to the controller 100 and may be input to the controller 100.

The controller 100 may be configured to stop the compressor 12 in response to the operation stop command, to open the bypass valve 33 with a delay from the stop of the compressor 12, and to operate the cold head 14 during at least a portion of a period from the stop of the compressor 12 to the opening of the bypass valve 33, which will be described in detail below.

As illustrated in FIG. 1, the controller 100 may be provided in the compressor 12 (for example, the controller 100 may be mounted on the compressor casing 38). Alternatively, the controller 100 may be provided in the cold head 14. Alternatively, the controller 100 may be provided as a control device separate from the compressor 12 and the cold head 14 and may be connected to the compressor 12 and the cold head 14.

The controller 100 is implemented by elements or circuits including a CPU or a memory of a computer as a hardware configuration and is implemented by a computer program or the like as a software configuration. However, in FIG. 1, the controller 100 is appropriately illustrated as a functional block that is implemented by cooperation of these configurations. It will be understood by those skilled in the art that these functional blocks can be implemented in various manners by a combination of hardware and software.

When the main switch 50 is turned on and the cryocooler 10 is operated, the refrigerant gas collected from the cold head 14 to the compressor 12 flows from the low pressure port 41 to the suction port 24 of the compressor 12 through the low-pressure pipe 43. The refrigerant gas is collected to the suction port of the compressor main body 16 through the storage tank 30 on the suction flow path 28.

The refrigerant gas is compressed and pressurized by the compressor main body 16. The refrigerant gas delivered from the discharge port of the compressor main body 16 is cooled by the refrigerant gas cooling unit 34 on the discharge flow path 26 and is then purified by the oil separator 20 and the adsorber 21. Most of the oil mixed with the refrigerant gas in the compressor main body 16 is separated by the oil separator 20 and is then collected to the compressor main body 16. In this case, since the bypass valve 33 is closed, the refrigerant gas from the oil separator 20 does not flow to the bypass flow path 32, but flows to the adsorber 21. The refrigerant gas that has passed through the oil separator 20 is supplied to the adsorber 21, and the gaseous oil component remaining in the refrigerant gas is adsorbed and removed by the adsorber 21.

The refrigerant gas flows out from the compressor 12 through the discharge port 22 and is supplied to the inside of the cold head 14 through the high-pressure pipe 42 and the high pressure port 40. The low-temperature section 14*b* of the cold head 14 is cooled by the adiabatic expansion of the refrigerant gas in the cold head 14. The refrigerant gas whose pressure has been reduced in this manner is collected again from the cold head 14 to the compressor 12.

However, the present inventors found that, in the cryocooler 10 operated for a long period of time, a low-pressure-side refrigerant gas flow path (for example, the suction flow path 28, the low-pressure pipe 43, and the refrigerant gas charge port 31) through which the low-pressure refrigerant gas collected from the cold head 14 to the compressor 12 flowed could be contaminated with oil.

In the existing cryocooler 10, when the operation of the cryocooler 10 is stopped, the supply of power to each of the components, such as the compressor 12 and the cold head 14, in the cryocooler 10 is cut off at once. For example, the supply of power to the compressor motor 17, the bypass valve 33, and the cold head motor 15 is ended at the same time. The compressor motor 17 and the cold head motor 15 are stopped. At the same time, the bypass valve 33 is opened.

According to the study of the present inventors, it is considered that the above-described low-pressure-side oil contamination is caused by this operation stop operation and pressure equalization through the bypass flow path 32 based on the operation stop operation.

When the bypass valve 33 is opened, the refrigerant gas flows from the discharge flow path 26 to the suction flow path 28 through the bypass flow path 32 according to the pressure difference between the discharge flow path 26 and the suction flow path 28. A portion of the refrigerant gas flows from the bypass flow path 32 to the compressor main body 16, but most of the refrigerant gas from the bypass flow path 32 flows back to the suction port 24 and the refrigerant gas charge port 31 through the suction flow path 28 as represented by a dashed arrow 60 in FIG. 1 and further flows back to the low-pressure pipe 43. The reason is that a flow path volume to the compressor main body 16 is smaller than a low-pressure-side flow path volume from the suction flow path 28 to the low pressure port 41 through the low-pressure pipe 43.

The oil in the refrigerant gas that flows back is separated by the oil separator 20. However, since the refrigerant gas does not pass through the adsorber 21, it may include a gaseous oil component (a very small amount of gaseous oil component). Therefore, it is considered that, during a long-term operation, oil is gradually accumulated in the low-pressure-side refrigerant gas flow path due to the refrigerant gas flowing back a very large number of times (for example, about 2500 on and off switching operations and pressure equalization and refrigerant gas backflow associated with the switching operations), which results in the oil contamination. When the oil is contaminated, complicated maintenance work, such as the cleaning of the inside of the flow path or the replacement of the pipe, is required, and it takes a lot of time, effort, and cost.

In addition, oil may be accumulated in the refrigerant gas charge port 31 due to the backflow of the refrigerant gas to the refrigerant gas charge port 31. When the refrigerant gas charge port 31 is opened for filling with the refrigerant gas, inconveniences, such as the ejection of oil along with gas and the contamination of surroundings, may also occur.

Figure 2:
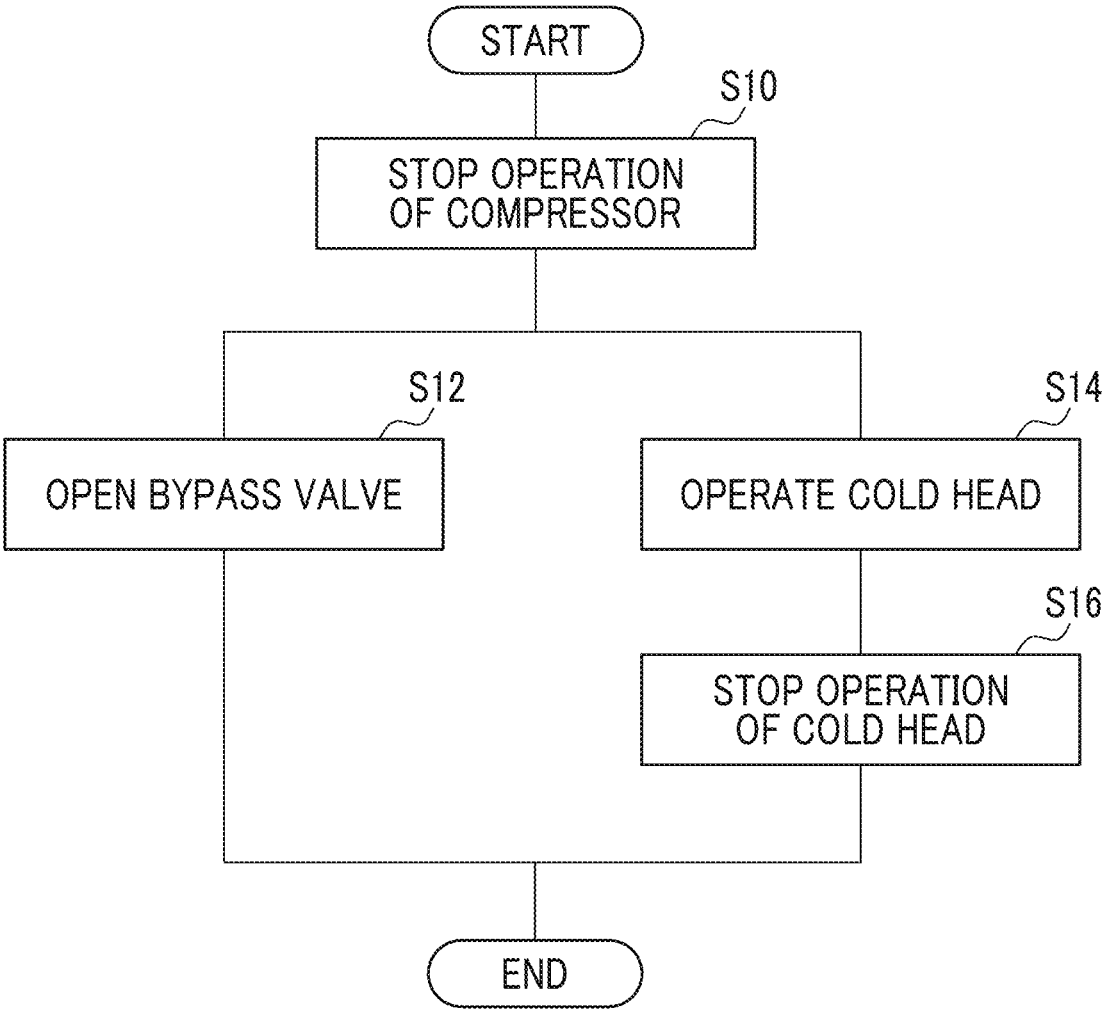
FIG. 2 is a flowchart illustrating a method for operating the cryocooler according to the embodiment.

FIG. 2 is a flowchart illustrating a method for operating the cryocooler 10 according to the embodiment. This method is a method for stopping the operation of the cryocooler 10 and is executed when the operation of the cryocooler 10 is ended. This operation stop method includes: stopping the operation of the compressor 12 (S10), opening the bypass valve 33 with a delay from the stop of the compressor 12 (S12), and operating the cold head 14 during at least a portion of the period from the stop of the compressor 12 to the opening of the bypass valve 33 (S14). In addition, as described above, the controller 100 may stop the compressor 12 in response to the operation stop command. Alternatively, the compressor 12 may be manually stopped.

In this method, when the compressor 12 is stopped, the bypass valve 33 is not immediately opened at the same time, but is kept closed for the delay time. The cold head 14 is operated during at least a portion of the delay time (that is, the period from the stop of the compressor 12 to the opening of the bypass valve 33). For example, the cold head 14 may be continuously operated before and after the compressor 12 is stopped. Then, the operation of the cold head 14 is stopped before the bypass valve 33 is opened, at the same time as the bypass valve 33 is opened, or after the bypass valve 33 is opened (S16).

Since the cold head 14 is operated in a state in which the bypass valve 33 is closed after the compressor 12 is stopped, the refrigerant gas can flow from the discharge flow path 26 to the suction flow path 28 through the cold head 14. In this way, it is possible to reduce the pressure difference between the discharge flow path 26 and the suction flow path 28 or to equalize the pressures of these flow paths through the cold head 14 instead of the bypass flow path 32. Then, after the bypass valve 33 is opened, the bypass flow path 32 can also be used to equalize the pressures of the discharge flow path 26 and the suction flow path 28.

As represented by a solid arrow 62 in FIG. 1, since the refrigerant gas flowing from the discharge flow path 26 to the suction flow path 28 through the cold head 14 is purified by the adsorber 21, oil contamination of the low-pressure-side refrigerant gas flow path is avoided as much as possible. Therefore, the above-described issues, such as complicated maintenance work caused by oil contamination and the ejection of oil from the refrigerant gas charge port 31, are settled or alleviated.

For example, the method for stopping the operation of the cryocooler 10 according to the embodiment in which, after the compressor 12 is stopped, the opening of the bypass valve 33 is delayed and the operation of the cold head 14 is temporarily continued may be based on pressure measurement after the compressor 12 is stopped. In this case, the controller 100 may be configured (i) to acquire the pressure measured by the pressure sensor 37 after the compressor 12 is stopped and while the cold head 14 is being operated and (ii) to open the bypass valve 33 and to stop the cold head 14 on the basis of the acquired pressure. An example of this operation stop method will be described below with reference to FIGS. 3 and 4.

Figure 3:
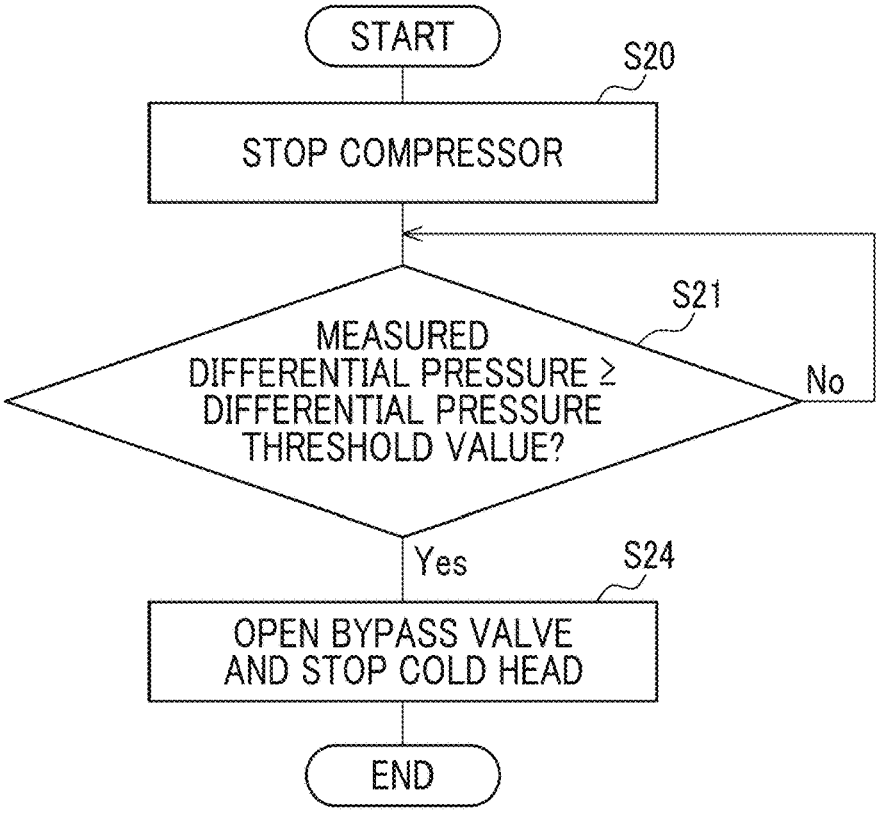
FIG. 3 is a flowchart illustrating an example of the method for operating the cryocooler according to the embodiment.

FIG. 3 is a flowchart illustrating an example of the method for operating the cryocooler 10 according to the embodiment. This method is executed by the controller 100 when the operation of the cryocooler 10 is stopped. For example, the controller 100 may start this method in response to the above-described operation stop command.

In this method, first, as illustrated in FIG. 3, the operation of the compressor 12 is stopped (S20). In a case where the operation stop command is acquired by the controller 100, the controller 100 may stop the supply of power to the compressor motor 17 to stop the compressor 12 in response to the operation stop command. In this case, as described above, the compressor 12 is stopped, but the operation of the cold head 14 is continued without being stopped. Further, the bypass valve 33 is kept closed.

When the compressor 12 is stopped, the differential pressure between the inlet and outlet of the bypass valve 33 is monitored (S21). For example, the controller 100 may receive the first measured pressure signal PH from the first pressure sensor 37*a*, receive the second measured pressure signal PL from the second pressure sensor 37*b*, and acquire the differential pressure between the inlet and outlet of the bypass valve 33 on the basis of the first measured pressure signal PH and the second measured pressure signal PL. The first measured pressure signal PH indicates the pressure of the discharge flow path 26 measured by the first pressure sensor 37*a*, that is, the inlet-side pressure of the bypass valve 33, and the second measured pressure signal PL indicates the pressure of the suction flow path 28 measured by the second pressure sensor 37*b*, that is, the outlet-side pressure of the bypass valve 33. Therefore, the difference between the two measured pressures can be calculated to acquire the differential pressure between the inlet and outlet of the bypass valve 33. In this way, the controller 100 can acquire the measured differential pressure between the inlet and outlet of the bypass valve 33 after the compressor 12 is stopped.

In the monitoring of the differential pressure after the compressor 12 is stopped (S21), the controller 100 compares the acquired differential pressure (that is, the measured differential pressure between the inlet and outlet of the bypass valve 33) with a differential pressure threshold value. The differential pressure threshold value can be appropriately set on the basis of, for example, empirical knowledge of a designer or experiments or simulations by the designer. For example, the differential pressure threshold value may be set to a pressure value at a level at which the differential pressure between the discharge flow path 26 and the suction flow path 28 is considered to be reduced or eliminated from the viewpoint of settling the above-described oil contamination issues. For example, the differential pressure threshold value may be a pressure value that is equal to or less than a predetermined percentage (for example, equal to or less than ½ or equal to or less than 1/10) of the differential pressure (for example, the differential pressure measured first in the monitoring of the differential pressure in S21) between the discharge flow path 26 and the suction flow path 28 measured when the compressor 12 is stopped. Alternatively, the differential pressure threshold value may be a pressure value that is equal to or less than a predetermined percentage of a design differential pressure value between the discharge flow path 26 and the suction flow path 28 during the operation of the compressor 12. The differential pressure threshold value may be, for example, a pressure value that is equal to or less than 1 MPa or a pressure value that is equal to or less than 0.1 MPa.

When the acquired differential pressure is greater than the differential pressure threshold value (No in S21), the controller 100 waits for a predetermined time and then performs the above-described comparison between the acquired differential pressure and the differential pressure threshold value again (S21). It is expected that the pressure equalization of the discharge flow path 26 and the suction flow path 28 will be promoted by the flow of the refrigerant gas from the discharge flow path 26 to the suction flow path 28 through the cold head 14 during the waiting time.

When the acquired differential pressure is less than the differential pressure threshold value (Yes in S21), the controller 100 opens the bypass valve 33 to stop the cold head 14 (S24). In a case where the bypass valve 33 is a normally open valve, the controller 100 may stop the supply of power to the bypass valve 33 to open the bypass valve 33. Further, the controller 100 may stop the supply of power to the cold head motor 15 to stop the cold head 14. The opening of the bypass valve 33 and the stopping of the cold head 14 are performed in a random order. The opening and the stopping may be performed at the same time or either of them may be performed first. In addition, in a case where the acquired differential pressure is equal to or less than the differential pressure threshold value, the controller 100 may open the bypass valve 33 to stop the cold head 14. In this way, this operation stop method ends.

According to the method for stopping the operation of the cryocooler 10 illustrated in FIG. 3, the cold head 14 is operated in a state in which the bypass valve 33 is closed after the compressor 12 is stopped. Therefore, the refrigerant gas can flow from the discharge flow path 26 to the suction flow path 28 through the cold head 14. In this way, it is possible to reduce the pressure difference between the discharge flow path 26 and the suction flow path 28 or to equalize the pressures of these flow paths through the cold head 14 instead of the bypass flow path 32. Since the refrigerant gas passing through the cold head 14 is purified by the adsorber 21, it is possible to suppress the oil contamination that may occur on the low-pressure side as described above. Further, it is possible to open the bypass valve 33 after confirming that the differential pressure between the inlet and outlet of the bypass valve 33 falls below a desired level in the monitoring of the differential pressure (S21). It is possible to reduce the flow of the refrigerant gas from the discharge flow path 26 to the suction flow path 28 through the bypass valve 33 and to suppress the oil contamination on the low-pressure side which may occur due to the flow of the refrigerant gas.

Figure 4:
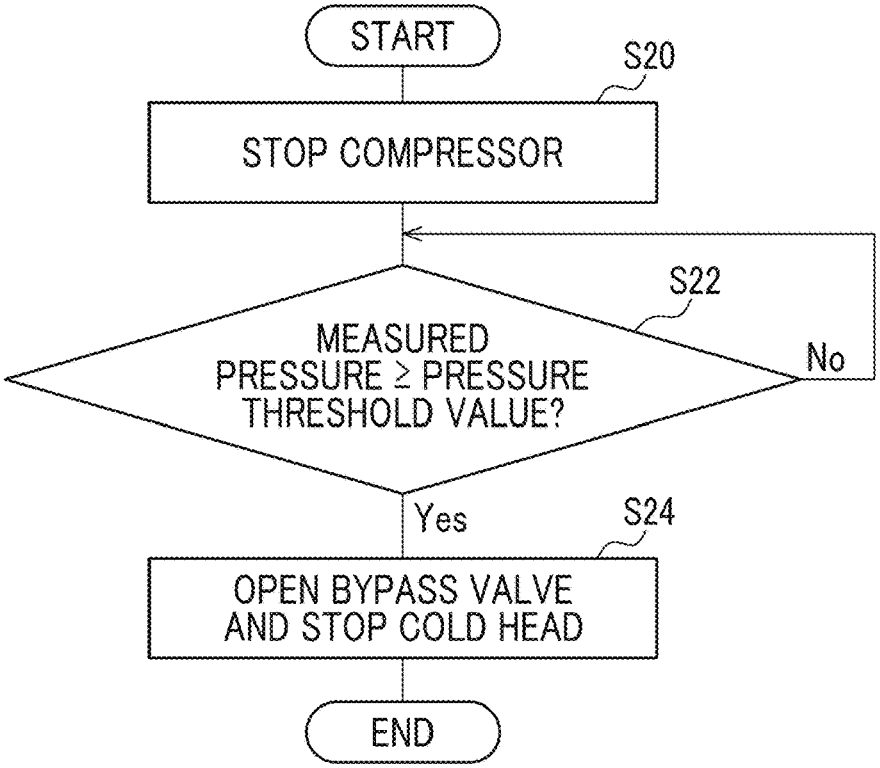
FIG. 4 is a flowchart illustrating an example of the method for operating the cryocooler according to the embodiment.

FIG. 4 is a flowchart illustrating an example of the method for operating the cryocooler 10 according to the embodiment. This method is executed by the controller 100 when the operation of the cryocooler 10 is stopped as in the method illustrated in FIG. 3. In the method illustrated in FIG. 3, the differential pressure between the inlet and outlet of the bypass valve 33 is monitored. However, in the operation stop method illustrated in FIG. 4, the inlet-side pressure of the bypass valve 33 is monitored.

First, the compressor 12 is stopped (S20). When the compressor 12 is stopped, the inlet-side pressure of the bypass valve 33 is monitored (S22). For example, the controller 100 may receive the first measured pressure signal PH from the first pressure sensor 37*a* and acquire the inlet-side pressure of the bypass valve 33 on the basis of the first measured pressure signal PH. In the monitoring of the pressure (S22), the controller 100 compares the acquired pressure with a pressure threshold value. The pressure threshold value can be appropriately set on the basis of, for example, empirical knowledge of the designer or experiments or simulations by the designer.

When the acquired pressure is greater than the pressure threshold value (No in S22), the controller 100 waits for a predetermined time and then monitors the pressure again (S22). On the other hand, when the acquired pressure is less than the pressure threshold value (Yes in S22), the controller 100 opens the bypass valve 33 and stops the cold head 14 (S24). Then, this operation stop method ends.

Even in this case, similarly to the operation stop method illustrated in FIG. 3, the cold head 14 is operated in a state in which the bypass valve 33 is closed after the compressor 12 is stopped. Therefore, the refrigerant gas can flow from the discharge flow path 26 to the suction flow path 28 through the cold head 14 to equalize the pressures. Therefore, it is possible to respond to the above-described oil contamination issues.

Similarly, the outlet-side pressure of the bypass valve 33 may be monitored. In this case, after the compressor 12 is stopped, the controller 100 may receive the second measured pressure signal PL from the second pressure sensor 37*b* and acquire the outlet-side pressure of the bypass valve 33 on the basis of the second measured pressure signal PL. The controller 100 may compare the acquired pressure with the pressure threshold value, wait when the acquired pressure falls below the pressure threshold value, monitor the pressure again, and open the bypass valve 33 and stop the cold head 14 when the acquired pressure is greater than the pressure threshold value.

As another example of the method for stopping the operation of the cryocooler 10 according to the embodiment, a method can also be adopted in which, in a case where the rotating speeds of the compressor motor 17 and the cold head motor 15 can be controlled, the rotating speeds of the two motors are reduced in different ways when the operation is stopped as described below. As described above, the rotating speed of the compressor motor 17 may be controlled by the compressor inverter, and the rotating speed of the cold head motor 15 may be controlled by the cold head inverter.

In this case, the controller 100 may be configured to stop the compressor motor 17 according to a first speed profile and to stop the cold head motor 15 according to a second speed profile. The first speed profile may be set to decrease the speed of the compressor motor 17 to stop the compressor motor 17 at a first timing. The second speed profile may be set to decrease the speed of the cold head motor 15 to stop the cold head motor 15 at a second timing delayed from the first timing.

Figure 5A:
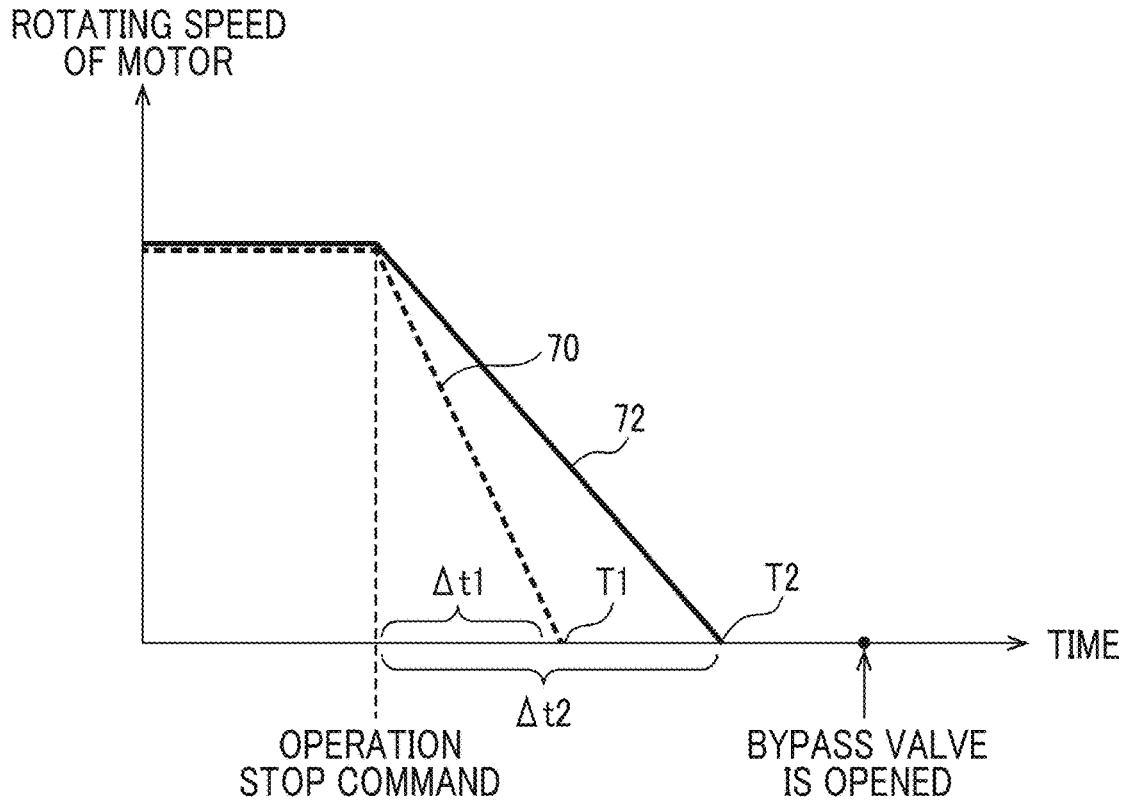
FIGS. 5A and 5B are schematic diagrams illustrating examples of speed profiles of a compressor motor and a cold head motor according to the embodiment.
Figure 5B:
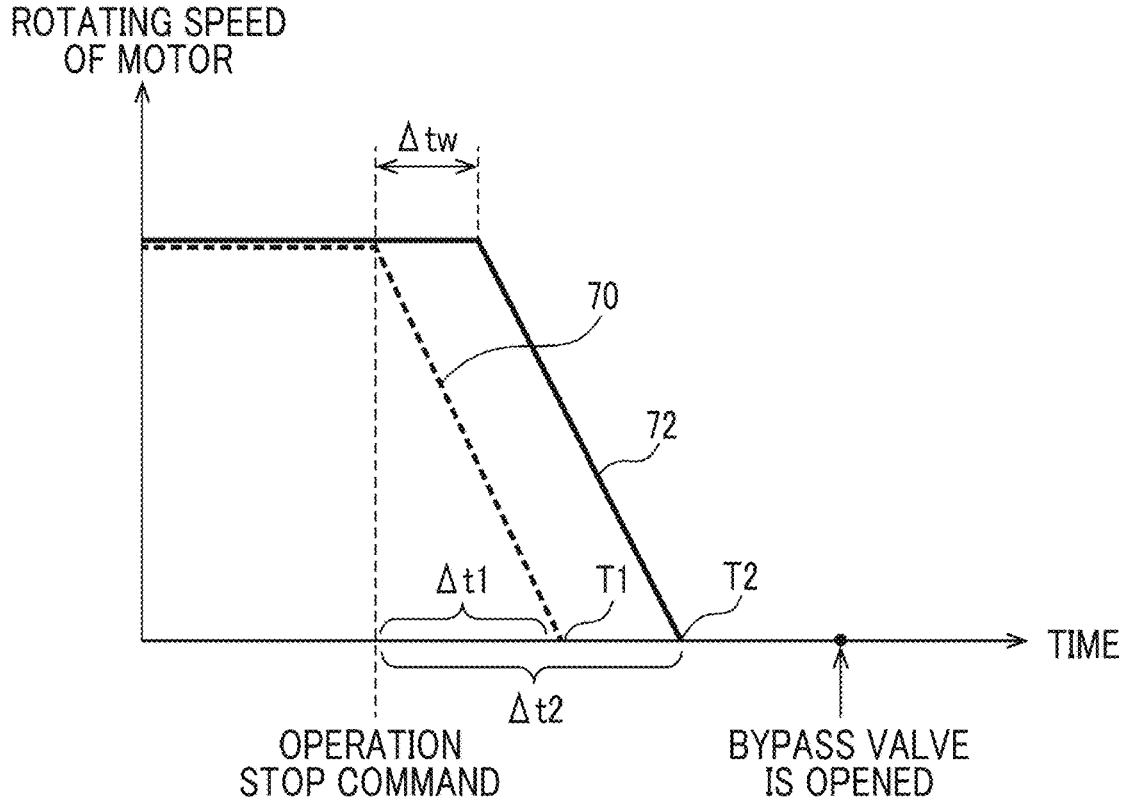

FIGS. 5A and 5B are schematic diagrams illustrating examples of the speed profiles of the compressor motor 17 and the cold head motor 15 according to the embodiment. In FIGS. 5A and 5B, a vertical axis indicates the rotating speed of the motor, and a horizontal axis indicates an elapsed time. A first speed profile 70 for the compressor motor 17 is represented by a broken line, and a second speed profile 72 for the cold head motor 15 is represented by a solid line.

In the example illustrated in FIG. 5A, in the second speed profile 72, a decrease rate of the rotating speed of the motor is less than that in the first speed profile 70. Therefore, as illustrated in FIG. 5A, the compressor motor 17 is stopped at a first timing T1 that is a first time Δt1 after a command to stop the operation of the cryocooler 10. On the other hand, the cold head motor 15 is stopped at a second timing T2 that is a second time Δt2 after the operation stop command. The second time Δt2 is longer than the first time Δt1, and the second timing T2 is delayed from the first timing T1.

Further, in the example illustrated in FIG. 5B, the decrease rate of the rotating speed of the motor is the same in the first speed profile 70 and the second speed profile 72. However, the start of the decrease in the rotating speed of the motor in the second speed profile 72 is delayed from that in the first speed profile 70 by a waiting time Δtw. As a result, the compressor motor 17 is stopped at the first timing T1 that is the first time Δt1 after the command to stop the operation of the cryocooler 10. On the other hand, the cold head motor 15 is stopped at the second timing T2 that is the second time Δt2 after the operation stop command. In addition, the setting of the waiting time Δtw may be used in combination with the example illustrated in FIG. 5A.

Even in this case, similarly to the operation stop method illustrated in FIG. 3, the cold head 14 is operated in a state in which the bypass valve 33 is closed after the compressor 12 is stopped. Therefore, the refrigerant gas can flow from the discharge flow path 26 to the suction flow path 28 through the cold head 14 to equalize the pressures. As a result, it is possible to respond to the above-described oil contamination issues.

The controller 100 may be configured to open the bypass valve 33 after the cold head 14 is stopped. In this case, the bypass valve 33 can be opened after the pressure equalization is performed through the cold head 14 as the operation of the cold head 14 continues. It is possible to reduce the flow of the refrigerant gas through the bypass valve 33 and to suppress the oil contamination on the low-pressure side which may occur due to the flow of the refrigerant gas.

In addition, this operation stop method based on the decrease rate of the rotating speed of the motor may be used in combination with the monitoring of the differential pressure described with reference to FIG. 3 or the monitoring of the pressure described with reference to FIG. 4. In this case, after the first timing T1 when the compressor motor 17 is stopped, the controller 100 may open the bypass valve 33 and stop the cold head 14 (that is, the cold head motor 15) on the basis of the comparison between the measured differential pressure and the differential pressure threshold value or the comparison between the measured pressure and the pressure threshold value as described above.

Figure 6:
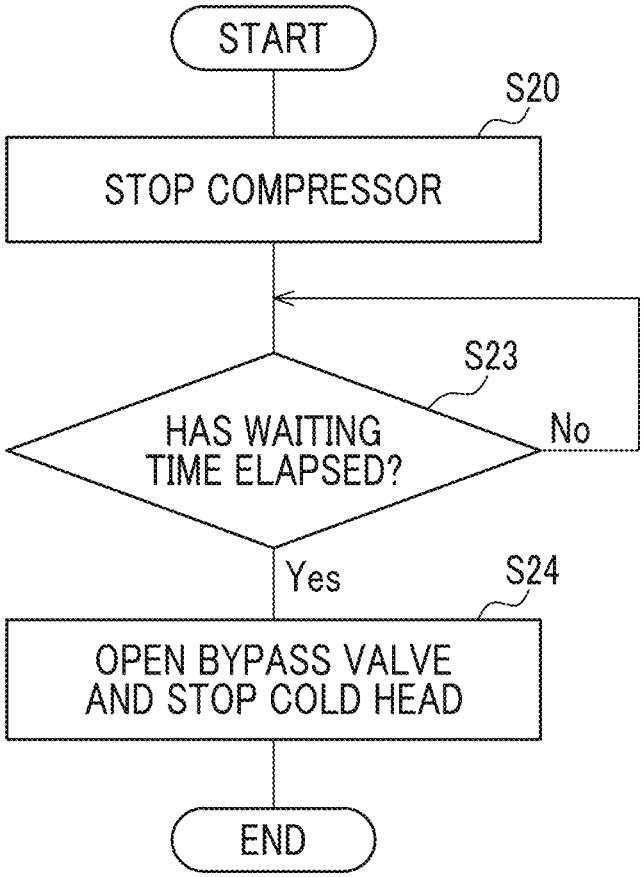
FIG. 6 is a flowchart illustrating an example of the method for operating the cryocooler according to the embodiment.

FIG. 6 is a flowchart illustrating an example of the method for operating the cryocooler 10 according to the embodiment. This method is executed by the controller 100 when the operation of the cryocooler 10 is stopped as in the method illustrated in FIG. 3. In the method illustrated in FIG. 3, the differential pressure between the inlet and outlet of the bypass valve 33 is monitored. However, in the operation stop method illustrated in FIG. 6, the waiting time is counted. The method illustrated in FIG. 6 is easy to execute and is advantageous.

First, the compressor 12 is stopped (S20). When the compressor 12 is stopped, a predetermined waiting time is counted (S23). For example, the controller 100 may count the waiting time from the time when the compressor 12 is stopped, using a built-in timer. The waiting time may be predetermined and set in the controller 100. The waiting time can be appropriately set on the basis of, for example, empirical knowledge of the designer or experiments or simulations by the designer. For example, from the viewpoint of settling the above-described oil contamination issues, the waiting time may be set to a time when the differential pressure between the discharge flow path 26 and the suction flow path 28 is expected to be reduced or eliminated, counting from the stop of the compressor 12. The waiting time may be, for example, a time of 10 seconds or less or a time of 5 seconds or less.

The controller 100 waits until the waiting time elapses (No in S23). On the other hand, when the waiting time has elapsed (Yes in S23), the controller 100 opens the bypass valve 33 and stops the cold head 14 (S24). Then, this operation stop method ends.

Even in this case, similarly to the operation stop method illustrated in FIG. 3, the cold head 14 is operated in a state in which the bypass valve 33 is closed after the compressor 12 is stopped. Therefore, the refrigerant gas can flow from the discharge flow path 26 to the suction flow path 28 through the cold head 14 to equalize the pressures. Therefore, it is possible to respond to the above-described oil contamination issues.

In addition, the controller 100 may be configured to open the bypass valve 33 after the cold head 14 is stopped. In this case, when the waiting time has elapsed (Yes in S23), the cold head 14 is stopped first, and then the bypass valve 33 is opened. In this case, it is possible to open the bypass valve 33 after completing the pressure equalization through the cold head 14.

In addition, the method illustrated in FIG. 6 may include the monitoring of the differential pressure described with reference to FIG. 3 or the monitoring of the pressure described with reference to FIG. 4. In this case, even when the waiting time has not elapsed (No in S23), the controller 100 may open the bypass valve 33 and stop the cold head 14 on the basis of the comparison between the measured differential pressure and the differential pressure threshold value or the comparison between the measured pressure and the pressure threshold value as described above.

The present invention has been described above on the basis of the examples. It will be understood by those skilled in the art that the present invention is not limited to the embodiment, various design changes are possible, various modification examples are possible, and the modification examples are also within the scope of the present invention. Various features described concerning a certain embodiment are also applicable to other embodiments. A new embodiment resulting from combinations also has the effects of each of the combined embodiments.

In the above-described embodiment, the bypass flow path 32 is connected between the oil separator 20 and the adsorber 21 on the discharge flow path 26. However, the bypass flow path 32 may be connected to another location on the discharge flow path 26. For example, the bypass flow path 32 may be connected between the adsorber 21 and the discharge port 22. In this case, when the bypass valve 33 is opened, the refrigerant gas purified by the adsorber 21 can flow from the discharge flow path 26 to the suction flow path 28. Therefore, the oil contamination on the low-pressure side can be reduced, which is advantageous.

In the above-described embodiment, the bypass flow path 32 is provided inside the compressor 12. However, the bypass flow path 32 may be provided outside the compressor 12. For example, the bypass flow path 32 may be disposed outside the compressor casing 38 and may connect the high-pressure pipe 42 and the low-pressure pipe 43. Further, the pressure sensor 37 including the first pressure sensor 37*a* and the second pressure sensor 37*b* is not essential to be provided in the compressor 12 and may be provided at any location, such as the high-pressure pipe 42, the low-pressure pipe 43, or the cold head 14, where pressure can be measured.

The present invention has been described above on the basis of the examples. It will be understood by those skilled in the art that the present invention is not limited to the embodiment, various design changes are possible, various modification examples are possible, and the modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a compressor;

a cold head;

a bypass valve that is connected to the compressor to bypass the cold head; and a controller that is configured to:

stop the compressor, open the bypass valve with a delay from the stopping of the compressor, and operate the cold head during at least a portion of a period from the stopping of the compressor to the opening of the bypass valve.

2. The cryocooler according to claim 1, further comprising:

a pressure sensor that measures a differential pressure between an inlet and an outlet of the bypass valve, an inlet-side pressure of the bypass valve, or an outlet-side pressure of the bypass valve, wherein the controller is configured to:

acquire the pressure measured by the pressure sensor after the compressor is stopped and while the cold head is being operated, and open the bypass valve and stop the cold head on the basis of the acquired pressure.

3. The cryocooler according to claim 2, wherein the controller is configured to:

acquire the measured differential pressure between the inlet and the outlet of the bypass valve, compare the acquired differential pressure with a differential pressure threshold value, and open the bypass valve and stop the cold head when the acquired differential pressure is less than the differential pressure threshold value.

4. The cryocooler according to claim 1, wherein the compressor includes a compressor motor that drives the compressor, the cold head includes a cold head motor that drives the cold head, the controller is configured to stop the compressor motor according to a first speed profile and to stop the cold head motor according to a second speed profile, the first speed profile is set to decrease a speed of the compressor motor to stop the compressor motor at a first timing, and the second speed profile is set to decrease a speed of the cold head motor to stop the cold head motor at a second timing delayed from the first timing.

5. The cryocooler according to claim 1, wherein the controller is configured to:

count a predetermined waiting time from when the compressor stops, and stop the cold head when the waiting time has elapsed.

6. The cryocooler according to claim 4, wherein the controller is configured to open the bypass valve after stopping the cold head.

7. A method for operating a cryocooler including a compressor, a cold head, and a bypass valve connected to the compressor to bypass the cold head, the method comprising:

stopping the compressor;

opening the bypass valve with a delay from the stopping of the compressor; and operating the cold head during at least a portion of a period from the stopping of the compressor to the opening of the bypass valve.

* * * * *